US005295842A

United States Patent [19]

Ozaki et al.

[11] Patent Number: 5,295,842

[45] Date of Patent: Mar. 22, 1994

[54] ELECTRIC JUNCTION BOX

[75] Inventors: Keiichi Ozaki; Masami Sakamoto; Eiji Shimochi, all of Shizuoka, Japan

[73] Assignee: Yazaki Corporation, Tokyo, Japan

[21] Appl. No.: 894,634

[22] Filed: Jun. 5, 1992

[30] Foreign Application Priority Data

Jun. 25, 1991 [JP] Japan ..... 3-153071

[51] Int. Cl.[5] ..... H01R 11/01; H01R 11/11; H01R 13/46

[52] U.S. Cl. ..... 439/76; 439/883; 174/59

[58] Field of Search ..... 174/52.1, 59, 71 B, 174/88 B, 99 B; 361/386, 360, 361; 439/76, 113, 114, 212, 213, 249, 251, 883

[56] References Cited

U.S. PATENT DOCUMENTS 4,684,765 8/1987 Beck et al. ..... 439/76 X
4,689,718 8/1987 Maue et al. .
4,909,744 3/1990 Muto ..... 439/251 X
4,959,019 9/1990 Shimochi ..... 439/76
4,972,295 11/1990 Suguro et al. ..... 361/386
4,995,818 2/1991 Saimoto ..... 439/76 X
5,011,417 4/1991 Matsumoto et al. ..... 439/251 X
5,023,752 6/1991 Detter et al. ..... 439/76 X

FOREIGN PATENT DOCUMENTS 280836 9/1988 European Pat. Off. ..... 439/114

*Primary Examiner*—Peter Dungba Vo
*Attorney, Agent, or Firm*—Armstrong, Westerman, Hattori, McLeland & Naughton

[57] ABSTRACT

The electric junction box includes a casing 20-23 and a plurality of busbar conductors 30 accommodated in the casing, each of which consists of an insulating substrate 31 and a plurality of busbars 32 with upright tabs 33 arranged face-to-face on the substrate 31. The busbar conductors 30 are accommodated in at least two blocks A1 and A2 in the casing and wires 40 are provided for electrically connecting desired busbars 32 in different and/or the same block. The above construction allows a circuit-change to be made with ease and unnecessary circuits to be precluded. The overall weight and production costs of busbar conductors and thus the junction box are reduced.

4 Claims, 8 Drawing Sheets

ELECTRIC JUNCTION BOX

BACKGROUND OF THE INVENTION

1. Field of the Invention

The present invention relates to an electric junction box used in mutual connection of wire harnesses and the like.

2. Description of the Prior Art

An electric junction box used in mutual connection of wire harnesses generally has a construction such as shown in FIG. 9. In the figure, reference numeral 1 represents an upper case and 2 a lower case, the upper and lower cases 1 and 2 accommodating therebetween a plurality of busbar conductors 3A, 3B . . . stacked one on the other. Each busbar conductor consists of an insulating substrate 6 and a plurality of busbars 4 having desired patterns arranged on one or both surfaces of the substrate. Each busbar 4 is integrally formed with a plurality of upwardly or downwardly projecting tabs 5 adapted to pass through tab insertion holes 7 in insulating substrates 6 and project outside the upper or lower case 1, 2, whereat the tabs 5 are introduced into connectors such as connector insertion portions 11, fuse connectors 12 and relay connectors 13 to be connected to terminal parts of wire harnesses such as connectors 14, fuses 15 and relays 16 with or without the aid of male-female relay terminals 10. Designated 8 in the figure is a busbar-accommodating groove defined by opposing ribs 8*a*, 8*a*. Each busbar 4 is arranged in a groove 8 and prevented from inadvertent disengagement therefrom by having a weld boss 9 hot pressed with a jig (not shown).

Busbars 4 that form internal circuits of an electric junction box are conventionally formed by being punched out from the same conductive metal plate for each layer, thus rendering it difficult to introduce a change only to part of the busbars. As a result, in case motor vehicles of the same model, for example, are produced with several grades according to presence or non-presence of optional circuits, it is conventional practice that the busbars in one layer are of such combination as to provide a maximum capacity that suits the vehicles of the highest grade, resulting in some of the busbars remaining unused depending on the vehicle grade. Further, busbars (and busbar conductors) for use in vehicles of ore model are not usable in vehicles of another model due to differences in circuits, thus necessitating a fresh start in designing circuit-forming busbars and producing punching dies, which is very costly.

SUMMARY OF THE INVENTION

This invention has focused attention on the above problems and provides an electric junction box in which circuits of no use are precluded, and the overall weight of a busbar conductor and its production cost are reduced, and in which a change in circuit is readily made depending on the model and grade of the vehicle and the country that imports the vehicle.

To achieve the above objective, an electric junction box of this invention comprises: a casing, busbar conductors accommodated in the casing, each of which consists of an insulating substrate and a plurality of busbars with upright tabs arranged in face-to-face relation on the substrate, the busbar conductors being stacked one on the other at least in two blocks in the casing, and a wire or wires that electrically connect desired busbars in the same and/or different blocks with one another.

In the electric junction box of this invention, a plurality of busbar conductors 30, hitherto stacked in a single block, are stacked, for example, in two blocks of power supply side busbar block A1 and distribution side busbar block A2 as shown in FIG. 1, and electrical connection between desired busbars 32 in the same and/or different blocks is made by wires 40. With the construction as described above, a change in circuit is easily attained, thereby precluding busbars that remain unused and reducing the weight of the junction box. Further, the cost for producing the junction box is reduced, punching dies being not required to be renewed as in the prior art.

Connection of desired busbars with one another may be made with ease by providing, as shown in FIG. 2, a busbar 32 with a terminal portion 36 having a slot 36*a* and pressure-welding a wire 40 into the slot 36*a*. The terminal portion 36 is located at one side edge of the insulating substrate and is held between two neighboring substrates, with the result that no distortion or damages are caused to the terminal portion in pressure-welding a wire 40 thereinto. As a result, a stable electrical connection is obtained and leakage caused by contact of terminal portions is prevented.

DETAILED DESCRIPTION OF PREFERRED EMBODIMENT

Figure 3:
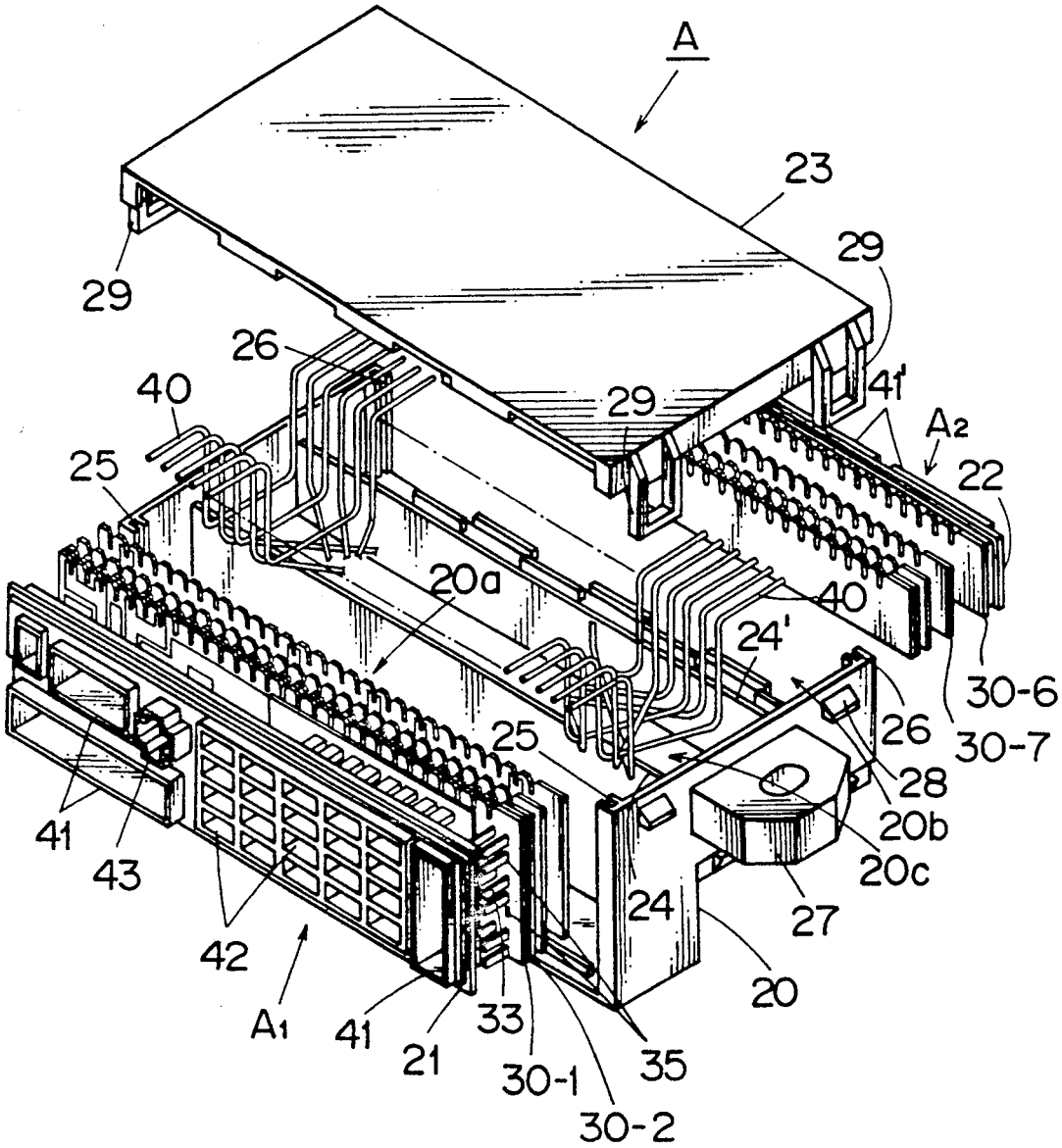
FIG. 3 is an exploded perspective view of an electric junction box as one embodiment of the invention.
Figure 4:
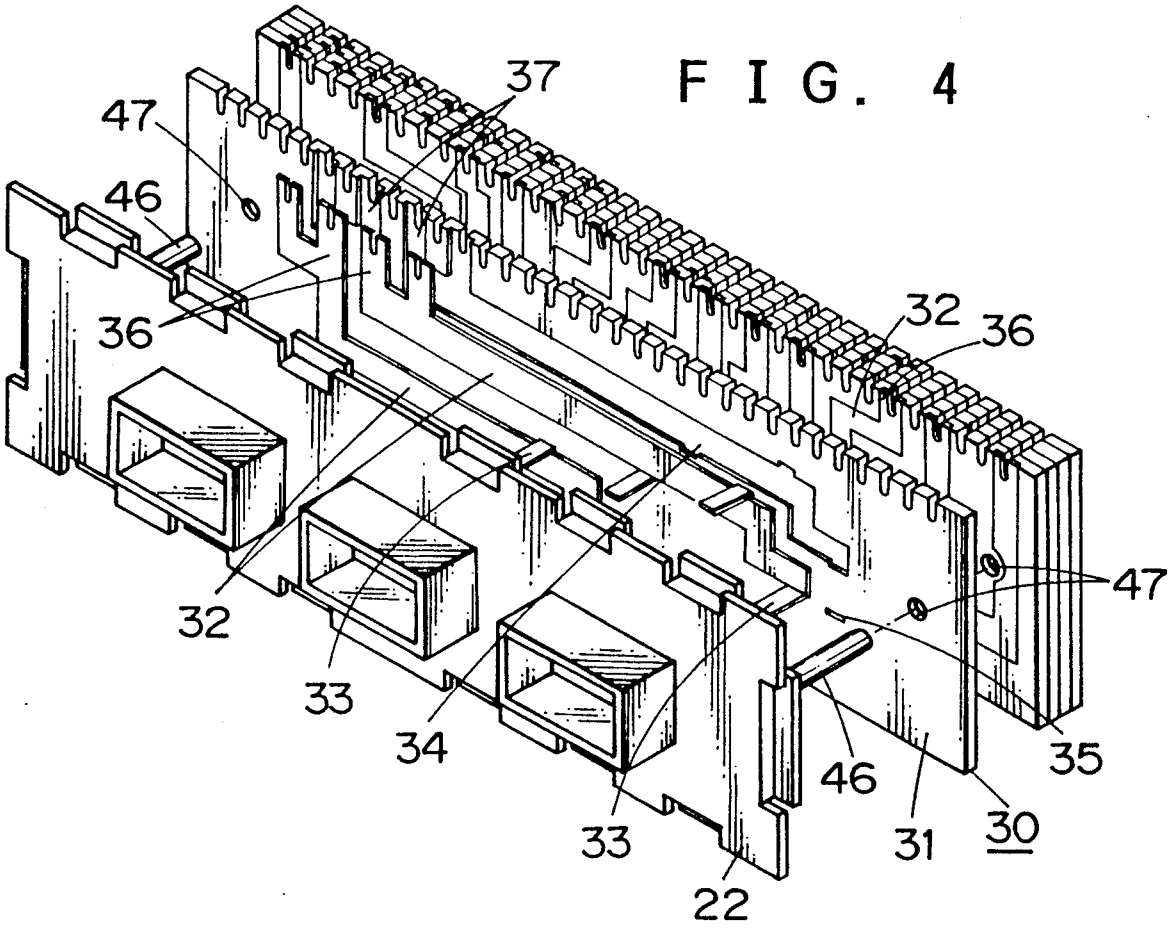
FIG. 4 is enlarged perspective view of essential parts of busbar conductors in FIG. 3.

In FIGS. 3 and 4, reference numeral 20 represents a case body for an electric junction box A. The case body 20 is forwardly, rearwardly and upwardly open so as to accommodate at the respective front, rear and intermediate portions a power supply side busbar block A1, a distribution side busbar block A2, and wires 40 that provide electrical connection between the two blocks. Designated 21 is a front cover, 22 a rear cover and 23 a top cover.

Extending between the side walls of the case body 20 are two partition walls 24, 24', which define at the front, rear and intermediate portions of the case body 20 a power supply side busbar block A1-accommodating room 20*a*, a distribution side busbar block A2-accommodating room 20*b* and a wire-accommodating room 20*c*, respectively. At its front and rear ends each side wall of the case body 20 is provided with insertion grooves 25, 25 and 26, 26 for the front and rear covers 21, 22. Each side wall is further provided on the outer surface thereof with an installment bracket 27 and engagement projections 28, the latter being adapted to engage resilient locking arms 29 of the top cover 23 to lock the cover 23 against inadvertent disengagement from the case body 20.

The power supply side busbar block A1 consists of the above-mentioned front cover 21 and a stack of busbar conductors 30-1, 30-2 . . . and the distribution side busbar block A2 consists of the rear cover 22 and a stack of busbar conductors 30-6, 30-7 . . . . Each busbar conductor consists of an insulating substrate 31 and a plurality of busbars 32 arranged on the substrate. Busbars 32 are formed by being Punched out to have desired patterns. Each busbar 32 is integrally formed at an end or intermediate portion thereof with an upright tab 33 and is arranged in a busbar-accommodating groove 34 formed in advance in the insulating substrate 31. Each insulating substrate 31 is provided with a tab-insertion hole(s) 35.

Figure 5:
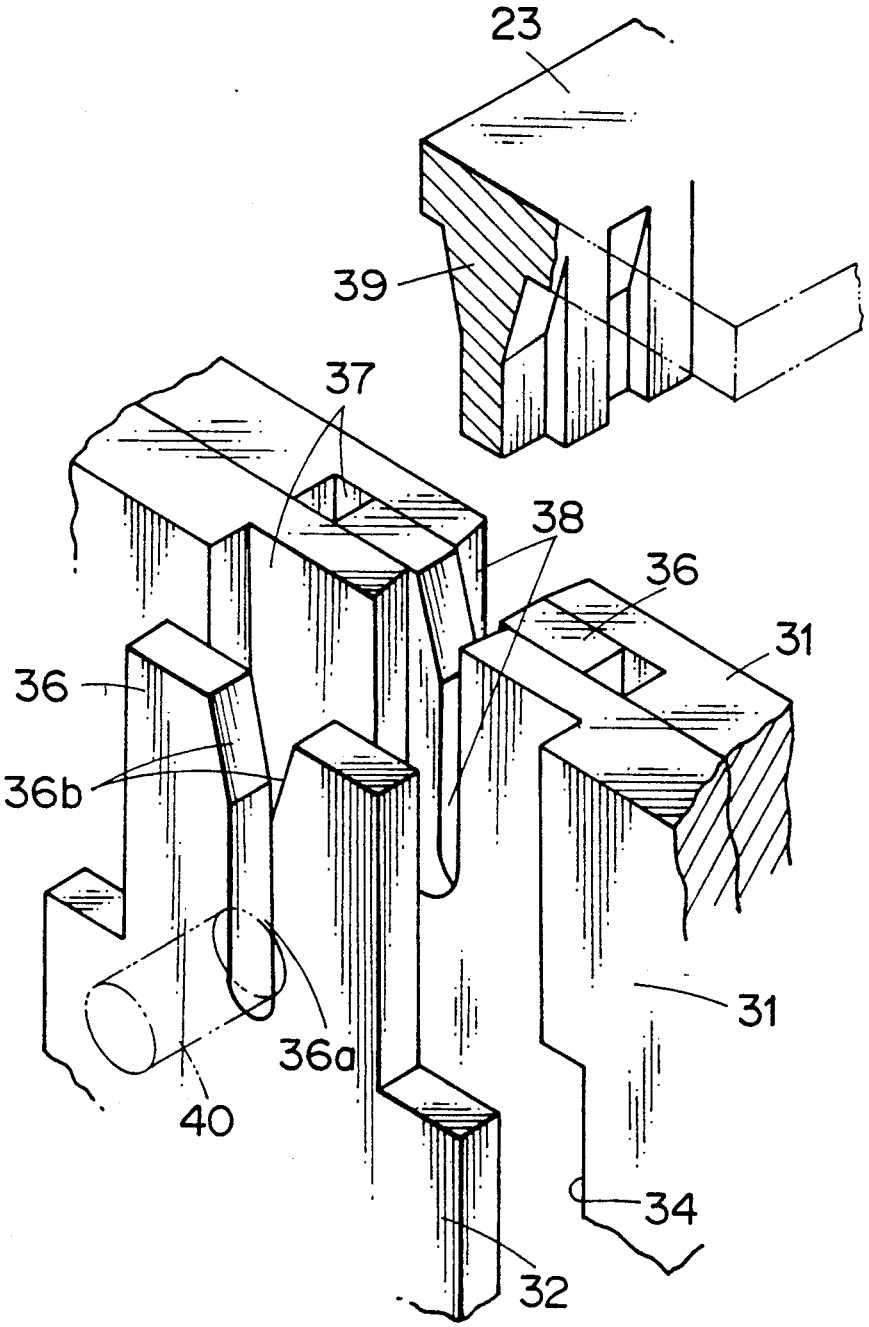
FIG. 5 is an enlarged perspective view showing a wire-pressure welding portion of FIG. 4.
Figure 6A:
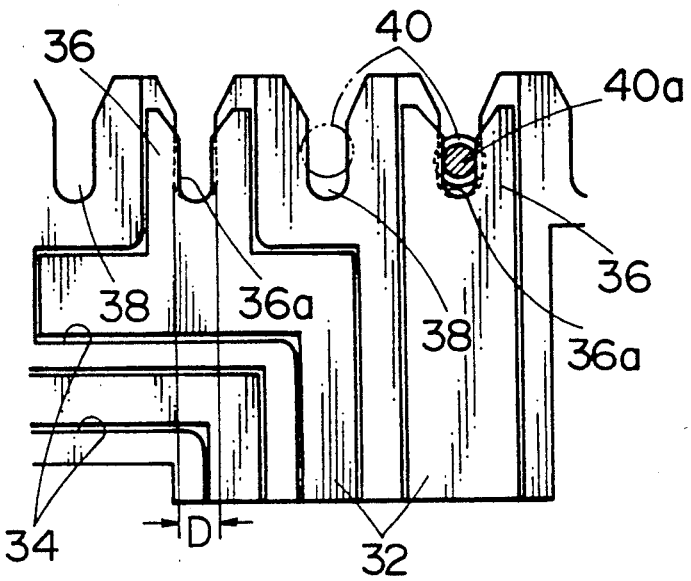
FIG. 6(A) is a front view of the busbar conductor of FIG. 5, 6(B) is a top view thereof, and 6(C) is a top view showing a state in which a wire is inserted in a wire engaging groove.
Figure 6B:
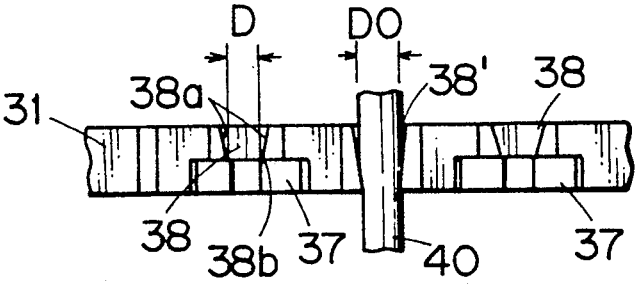

Busbar conductors of the invention are of the same basic construction as that of conventional ones. However, desired busbars 32 in the invention are each provided with one or more integrally formed pressure-welding terminal portions 36 extending toward one side edge (upper edge in the present embodiment) of the insulating substrate 31. Further, the insulating substrate 31 is provided at the side edge with grooves 37 in alignment with the terminal portions 36 for accommodating the same therein. As shown in FIG. 5, each terminal portion 36 has a U-shaped slot 36*a* for pressure-welding a wire 40 therein and tapers 36*b* at the open end of the slot 36*a* for the guidance of the wire 40 thereinto. The groove 37 is continuous with the busbar-accommodating groove 34, and in the groove 37 is formed a slit 38 which aligns with the slot 36*a* and, as will be described, serves to fix the wire 40 in place. As shown in FIG. 6(B), the slit 38, defined by the opposite wall surfaces 38*a*, 38*a*, is of a decreasing width in the direction toward the terminal portion-accommodating groove 37 such that its minimum width D, located at edge portions 38*b* adjoining the groove 37, is slightly smaller than the outer diameter D0 of the sheath of the wire 40. Reference numeral 38′ in FIG. 6(B) represents a wire-fixing slit at which is formed no groove 37 for accommodating the terminal portion 36. Projecting downwardly from the underside of the top cover 23 at positions corresponding to the U-shaped slots 36*a* and slits 38, 38′ are hold-down projections 39 for the wires 40.

Reverting to FIG. 3, to the outer surface of the front cover 21 are mainly provided connector insertion portions 41 and a number of fuse connectors 42 to which end connectors (not shown) of the power supply side wire harness are connected, along with a relay connector 43. To the rear cover 22 are mainly provided a plurality of connector insertion portions 41′ to which end connectors (not shown) of the load side wire harness are connected.

Figure 1:
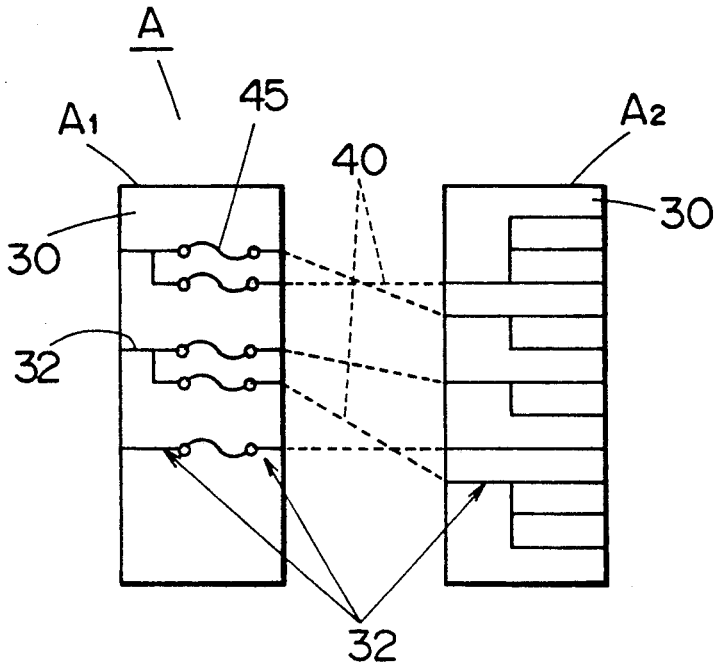
FIG. 1 is a block wiring diagram schematically illustrating an electric junction box as one embodiment of the invention.
Figure 2:
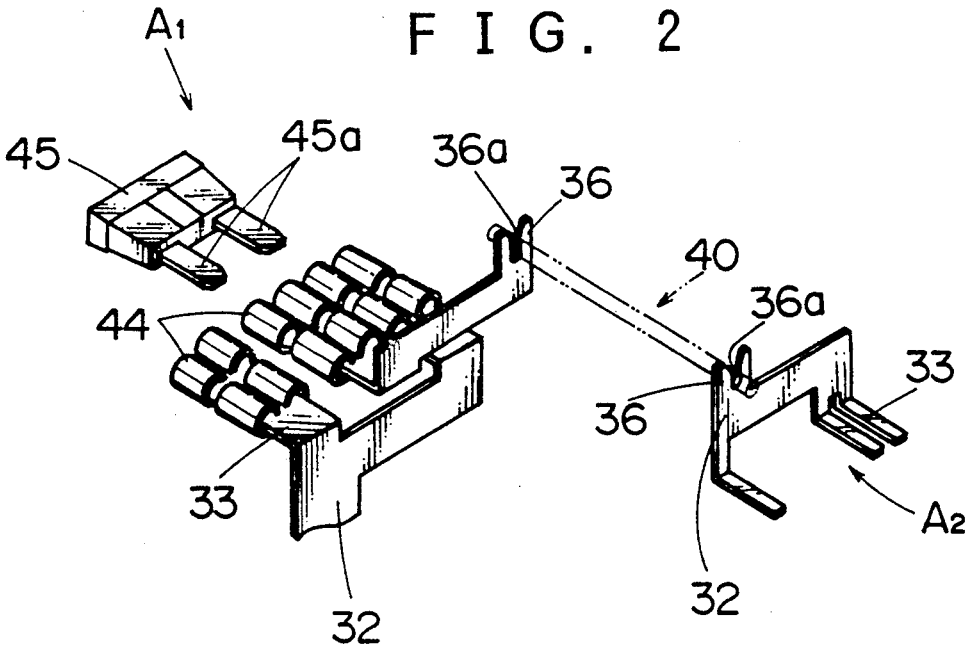
FIG. 2 is a perspective view or one example of the means for providing electrical connection between the blocks of FIG. 1.

The assembly of an electric junction box A will now be described. The power supply side busbar block A1 is assembled by stacking, as shown in FIG. 3, a plurality of busbar conductors 30-1, 30-2, . . . one on the other and placing on top of the thus stacked conductors a front cover 21, through which the upright tabs 33 pass to project into the connectors 41, 42, 43. As shown in FIG. 2, a female-female relay terminal 44 may be fitted at its one end over the upright tab 33 so that an electric component such as a fuse 45 with a tab-shaped connection terminal 45*a* is directly connected via the relay terminal 44 to the upright tab 33. The assembly of the distribution side busbar block A2 is the same as has been described in connection with the busbar block A1. The rear cover 22 (and the front cover 21), as shown in FIG. 4, has positioning pins 46 that project from the inner side thereof, and the insulating substrates 31 each have aligning pin-insertion-holes 47 so that in assembling the busbar blocks A1 and A2 the busbar conductors are facilitatedly stacked by the insertion of the pins 46 through the holes 47.

Figure 6C:
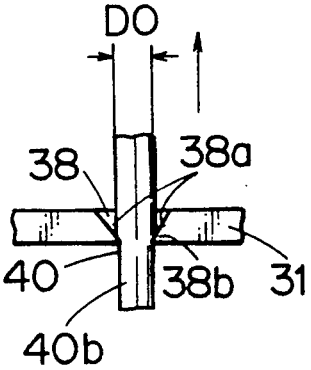

The thus assembled busbar blocks A1 and A2 are respectively accommodated in the accommodating rooms 20*a* and 20*b* and retained therein by having the lateral sides of each of the front and rear covers 21, 22 inserted into the associated insertion grooves 25, 25 and 26, 26 of the case body 20. In this state, in each of the busbar conductors 30-1, 302, . . . and 30-6, 30-7, . . . of the busbar blocks A1 and A2, terminal portions 36 extending from a plurality of desired busbars are placed into the associated accommodating grooves 37 and fixedly held between two neighboring insulating substrates 31, 31, as shown in FIG. 5. A desired circuit is then formed by pressure-welding a wire 40 at its both ends into the slots 36*a*, 36*a* of two predetermined terminal portions 36, 36, one in the block A1 and the other in the block A2, or both in the same block 1 or 2. As shown in FIGS. 6(A)–(C), when the wire 40 is force-fitted into a slot 36*a* with a jig (not shown), the conductor 40*a* of the wire 40 comes into a direct contact with the terminal portion 36. As described hereinbefore, the terminal portion 36 is fixedly held between two neighboring substrates 31, thereby precluding the possibility of distorting and damaging the terminal portion 36 in pressure welding and providing a stable electrical connection. Further, since the edge portions 38*b* of the slit-defining walls 38*a* bite in part into the insulating sheath 40*b* of the wire 40, a locking is provided for the wire 40 against a force to pull the same in the direction indicated by the arrow in FIG. 6(C), and thus is precluded an inadvertent disengagement.

Figure 7:
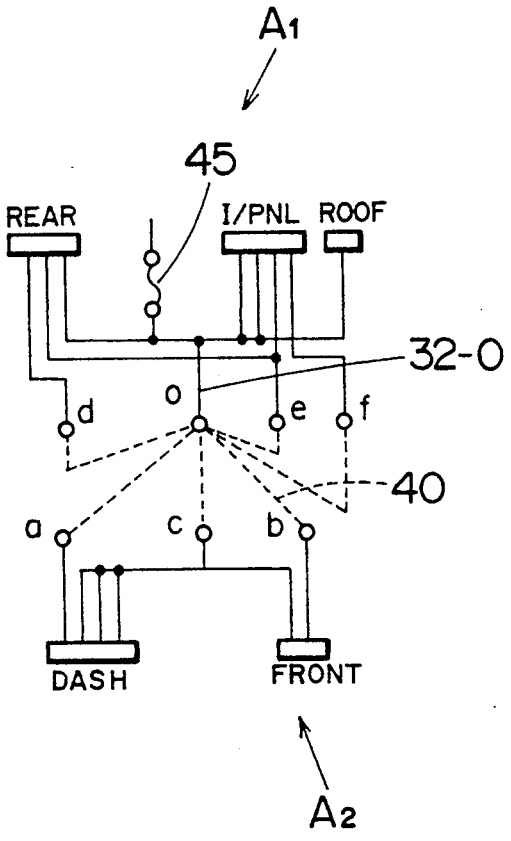
FIG. 7 is a block wiring diagram showing one example of electrical connection made between the blocks in the electric junction box of the invention.
Figure 8A:
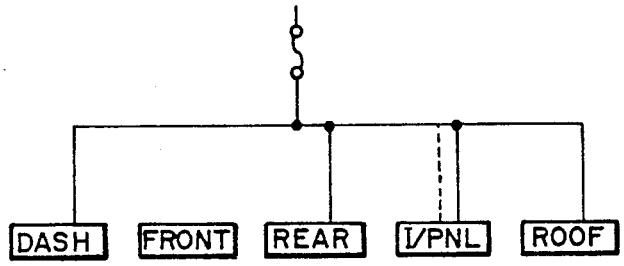
FIGS. 8(A)–8(D) are wiring diagrams of circuits each obtained by differently connecting the blocks of FIG. 7.
Figure 8B:
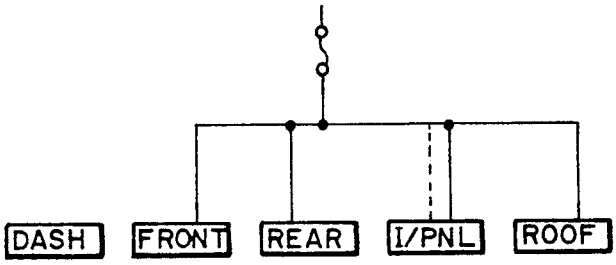
Figure 8C:
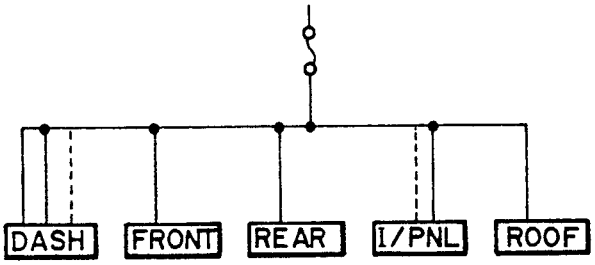
Figure 8D:
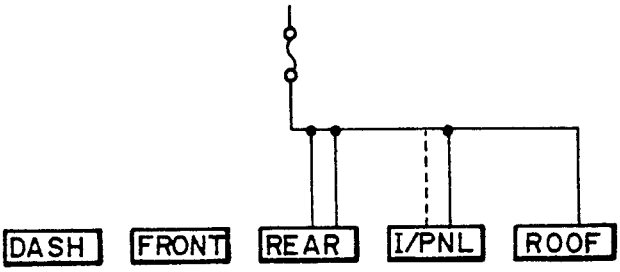
Figure 9:
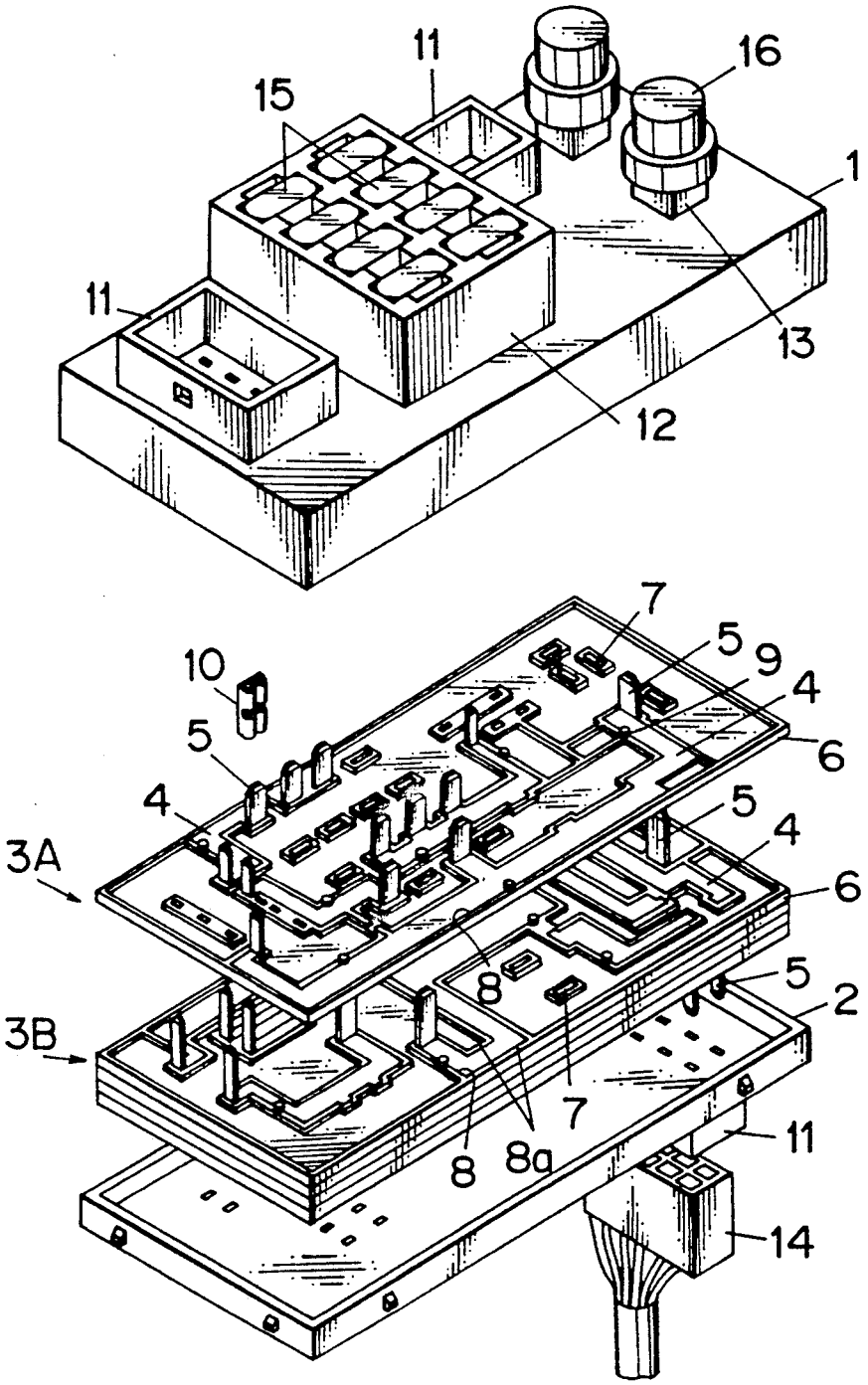
FIG. 9 PRIOR ART
FIG. 9 is an exploded perspective view showing one example of a conventional electric junction box.

FIG. 7 shows how a change in circuit between the blocks A1 and A2 is effected with a wire 40 in an electrical junction box according to the invention. In the FIG., REAR, I/PNL and ROOF respectively represent connector insertion portions for the receipt of end connectors of wire harnesses leading from the rear side, instrument panel side and roof side of a motor vehicle, the connector insertion portions being all mounted on the front cover 21 in FIG. 3. Likewise, DASH and FRONT respectively represent connector insertion portions for the receipt of end connectors of wire harnesses leading from the dashboard side and front engine chamber side of the vehicle, the connector insertion portions being both mounted on the rear cover 22 in FIG. 3. Reference symbols o, a, b, c, d, e and f represent terminal portions 36 of busbars 32 (FIG. 4) communicating to the connector insertion portions REAR - FRONT as mentioned above.

Wires 40 are anchored at their one ends to the terminal Portion o of a busbar 32-0 connected to the load side of the fuse 45. Now by pressure-welding and connecting the other ends of the wires 40 to selected ones of the points a, b, c and d, circuit patterns such as shown in FIGS. 8(A)–(D) are obtained (examples including connections to points e and f are omitted). Thus, by changing the terminal portions 36 (or busbars 32) that are connected with one another with wires 40, a change in circuit between the blocks A1 and A2 is easily attained.

The invention has been described hereinabove in conjunction with an embodiment in which a terminal portion 36 of each busbar 32 is placed in an associated accommodating groove 37 formed in the insulating substrate 31 and fixedly held between two neighboring substrates 31. However, the grooves 37 may be omitted and the terminal portions 36 may be arranged such that they project from one side edge of the substrate 31. Further, connection between the busbars 32 and wires 40 is not limited to pressure welding and may be made by other conventional means such as soldering or ultrasonic welding. In addition, the busbar conductors 30 (30-1, 30-2, . . . ) may in part or totally be replaced by printed circuit boards (HPC, FPC).

As described above, in accordance with the invention, an electric junction box is provided in which a change in circuit is readily made and busbar of no use are precluded and which is of reduced weight and cost. Further, the ease with which a circuit-change is attained makes the junction box of the invention versatile, thereby rendering it unnecessary to provide various kinds of busbar conductors for various vehicle-models and -grades and for various countries that import the vehicles.

What is claimed is:

1. An electric junction box comprising:

a casing;

a plurality of busbar conductors accommodated in said casing;

each of said busbar conductors including an insulating substrate and a plurality of electrically conductive busbars with upright tabs arranged said insulating substrate;

said busbar conductors being stacked in face-to-face relation one on the other and being arranged in at least two separate blocks in said casing;

each of said busbars having at least one terminal portion;

at least one wire electrically connectable to desired busbars at said terminal portions thereof such that busbars in one of said at least two blocks or busbars in said at least two blocks are selectively electronically connected with one another by said at least one wire.

2. An electric junction box as claimed in claim 1, wherein said terminal portions of said busbars each have a slot for pressure-welding an associated one of said at least one wire therein, said terminal portions each being arranged along a side edge of a respective insulating substrate of the busbar conductors.

3. An electric junction box as claimed in claim 2, wherein at least one of said insulating substrates is formed along a face thereof with at least one groove for accommodating its respective at least one terminal portion, the at least one terminal portion accommodated in the at least one groove being retained therein by an adjacent insulating substrate placed in contact and in face-to-face relation with the respective one of said at least one substrate.

4. An electric junction box as claimed in claim 3, wherein each said at least one groove includes a wire-fixing slit along said edge of the respective said insulating substrate.

* * * * *